US012796809B2

(12) United States Patent
Finses et al.

(10) Patent No.: US 12,796,809 B2
(45) Date of Patent: Nov. 17, 2026

(54) TABLE

(71) Applicant: MILLERKNOLL, INC., Zeeland, MI (US)

(72) Inventors: Tyler G. Finses, Holland, MI (US); Joel Graham Van Faasen, Holland, MI (US); Eric S. Wong, Saratoga, CA (US)

(73) Assignee: MillerKnoll, Inc., Zeeland, MI (US)

( * ) Notice: Subject to any disclaimer, the term of this patent is extended or adjusted under 35 U.S.C. 154(b) by 93 days.

(21) Appl. No.: 18/806,458

(22) Filed: Aug. 15, 2024

(65) Prior Publication Data

US 2025/0057311 A1 Feb. 20, 2025

Related U.S. Application Data

(60) Provisional application No. 63/520,296, filed on Aug. 17, 2023.

(51) Int. Cl.

| | |
|---|---|
| ***A47B 9/20*** | (2006.01) |
| ***A47B 91/02*** | (2006.01) |
| ***A47B 97/00*** | (2006.01) |

(52) U.S. Cl.

CPC ..... *A47B 9/20* (2013.01); *A47B 91/026* (2013.01); *A47B 97/00* (2013.01); *A47B 2097/003* (2013.01)

(58) Field of Classification Search

CPC ..... A47B 91/02; A47B 91/022; A47B 91/024; A47B 91/026; A47B 91/028; A47B 91/16; A47B 2220/003; A47B 21/06; A47B 92/06; A47B 91/066

USPC ..... 248/188.2, 188.4; 108/50.02

See application file for complete search history.

(56) References Cited

U.S. PATENT DOCUMENTS

| | | | | |
|---|---|---|---|---|
| 4,827,850 | A | 5/1989 | Diffrient | |
| 5,231,562 | A | 7/1993 | Pierce et al. | |
| 5,237,935 | A | 8/1993 | Newhouse et al. | |
| 5,533,457 | A * | 7/1996 | Cox | A47B 13/023 100/150 |
| 5,676,062 | A | 10/1997 | Lloyd | |

(Continued)

FOREIGN PATENT DOCUMENTS

| | | | | |
|---|---|---|---|---|
| CN | 111513464 A | | 7/1993 | |
| CN | 107874500 A | * | 4/2018 | A47B 91/16 |

(Continued)

OTHER PUBLICATIONS

English Translation of CN107874500.*

(Continued)

*Primary Examiner* — Daniel J Troy
*Assistant Examiner* — Elizabeth Irene Artalejo
(74) *Attorney, Agent, or Firm* — Michael Best & Friedrich LLP

(57) ABSTRACT

A table may include a worksurface. A table may include a leg coupled to the worksurface. A table may include a foot coupled to the leg, the foot configured to support the worksurface above a ground surface, the foot having an upper side that faces toward the worksurface and a lower side that is configured to face toward the ground surface. A table may include an adjustable glide supported by the foot, the adjustable glide being accessible from the upper side of the foot to axially move the glide relative to the foot and level the table.

11 Claims, 18 Drawing Sheets

(56) References Cited

U.S. PATENT DOCUMENTS

| | | | | |
|---|---|---|---|---|
| 5,881,979 | A * | 3/1999 | Rozier, Jr. | A47B 91/024 248/188.4 |
| 5,913,271 | A | 6/1999 | Lloyd | |
| 5,934,201 | A | 8/1999 | Diffrient | |
| 5,971,509 | A | 10/1999 | Deimen et al. | |
| 6,024,024 | A | 2/2000 | Favaretto | |
| 6,070,840 | A | 6/2000 | Kelley et al. | |
| 6,119,989 | A | 9/2000 | Hollington et al. | |
| 6,176,561 | B1 | 1/2001 | Roels et al. | |
| 6,196,140 | B1 | 3/2001 | Newhouse et al. | |
| 6,327,983 | B1 | 12/2001 | Cronk et al. | |
| 6,336,414 | B1 | 1/2002 | Stewart et al. | |
| 6,415,723 | B1 | 7/2002 | Kopish et al. | |
| 6,629,505 | B1 | 10/2003 | Cronk et al. | |
| 6,647,900 | B1 | 11/2003 | Kopish | |
| 6,895,868 | B1 | 5/2005 | Cronk et al. | |
| 6,983,570 | B2 * | 1/2006 | Mead | E04F 15/02452 248/188.4 |
| 7,066,097 | B2 | 6/2006 | Gayhart et al. | |
| 7,191,713 | B2 | 3/2007 | Gayhart et al. | |
| 7,549,381 | B1 | 6/2009 | Nail, Jr. et al. | |
| 8,061,279 | B2 | 11/2011 | Preiss | |
| 8,328,149 | B2 * | 12/2012 | McLaughlin | A47B 91/024 248/188.4 |
| 8,667,908 | B2 | 3/2014 | Martin et al. | |
| 9,185,974 | B2 | 11/2015 | Martin et al. | |
| 9,210,999 | B2 | 12/2015 | Martin et al. | |
| 9,585,468 | B2 | 3/2017 | Udagawa et al. | |
| 9,912,112 | B1 | 3/2018 | Black et al. | |
| 10,186,819 | B2 | 1/2019 | Black et al. | |
| 10,381,808 | B2 | 8/2019 | Byrne et al. | |
| 10,383,435 | B1 | 8/2019 | Lundberg et al. | |
| 10,470,563 | B2 | 11/2019 | Keller et al. | |
| 10,512,327 | B2 | 12/2019 | Pappas et al. | |
| 10,681,980 | B2 | 6/2020 | Martin et al. | |
| 10,750,854 | B2 | 8/2020 | Egger | |
| 10,842,266 | B2 | 11/2020 | Matthai et al. | |
| 11,284,715 | B2 | 3/2022 | Goldhammer et al. | |
| 11,291,302 | B2 | 4/2022 | Matthai et al. | |
| 11,317,716 | B2 | 5/2022 | Martin et al. | |
| 11,357,323 | B2 | 6/2022 | Nourse | |
| 11,399,627 | B2 | 8/2022 | Anderson et al. | |
| 11,406,181 | B2 | 8/2022 | Mulder et al. | |
| 2016/0198842 | A1 * | 7/2016 | Kang | G03B 21/145 108/1 |
| 2018/0110327 | A1 | 4/2018 | Keller et al. | |
| 2020/0352325 | A1 | 11/2020 | Martin et al. | |
| 2020/0390237 | A1 | 12/2020 | Cvek | |
| 2021/0085079 | A1 | 3/2021 | Martin et al. | |
| 2021/0106133 | A1 | 4/2021 | Anderson et al. | |
| 2021/0169220 | A1 | 6/2021 | Martin et al. | |
| 2021/0177142 | A1 | 6/2021 | Martin et al. | |
| 2021/0204690 | A1 | 7/2021 | Lim | |
| 2021/0212453 | A1 | 7/2021 | Mulder et al. | |
| 2022/0225761 | A1 | 7/2022 | Anderson et al. | |
| 2022/0378194 | A1 | 12/2022 | Lin | |
| 2022/0395090 | A1 | 12/2022 | Van Faasen et al. | |
| 2023/0087769 | A1 * | 3/2023 | Pizzi | A47F 3/0482 248/649 |

FOREIGN PATENT DOCUMENTS

| | | | | |
|---|---|---|---|---|
| DE | 102019108708 | A1 | 8/2020 | |
| EP | 1971243 | B1 | 6/2009 | |
| EP | 2575540 | B1 | 2/2016 | |
| EP | 2762036 | B1 | 4/2016 | |
| EP | 2752129 | B1 | 2/2018 | |
| EP | 3090652 | B1 | 5/2018 | |
| EP | 3406162 | A1 | 11/2018 | |
| EP | 3560379 | A2 | 10/2019 | |
| KR | 200445789 | Y1 * | 9/2009 | A47B 91/024 |
| WO | 2018101875 | A1 | 6/2018 | |
| WO | 2021087010 | A1 | 5/2021 | |
| WO | 2022106753 | A1 | 5/2022 | |
| WO | 2022243539 | A1 | 11/2022 | |

OTHER PUBLICATIONS

English Translation of KR200445789.*

Cable Management Tray, Vari, <https://www.vari.com/cable-management-tray/FD-ESDCBL.html>, publicly available as early as Jul. 2, 2020 (5 pages).

63Inch Gaming Desk, 60 Inch Z Shaped Carbon Fiber Surface Desktop PC Computer Gaming Table Gamer Workstation with Free Mouse Pad Cup Holder Headphone Hook Handle Rack, Black, BedStory, <https://www.walmart.com/ip/63Inch-Gaming-Desk-60-Inch-Z-Shaped-Carbon-Fiber-Surface-Desktop-PC-Computer-Table-Gamer-Workstation-Free-Mouse-Pad-Cup-Holder-Headphone-Hook-Handle/5305506988>, Accessed on Oct. 11, 2024 (4 pages).

International Search Report and Written Opinion for Application No. PCT/US2024/042550 dated Jan. 8, 2024 (11 pages).

* cited by examiner

TABLE

CROSS-REFERENCE TO RELATED APPLICATIONS

This application claims priority to U.S. Provisional Patent Application No. 63/520,296, filed Aug. 17, 2023, the entire contents of which are incorporated herein by reference.

BACKGROUND

The present invention relates generally to a table, and in particular, to a cable management system for a table and an adjustable glide for a table.

SUMMARY

In some aspects, the invention provides a table including: a worksurface; a leg coupled to the worksurface; a foot coupled to the leg, the foot configured to support the worksurface above a ground surface, the foot having an upper side that faces toward the worksurface and a lower side that is configured to face toward the ground surface; and an adjustable glide supported by the foot, the adjustable glide being accessible from the upper side of the foot to axially move the glide relative to the foot and level the table.

In some aspects, the invention provides a table including: a worksurface; a first side support coupled to an underside of the worksurface, the first side support defining a first side opening; a second side support coupled to the underside of the worksurface and spaced apart from the first side support, the second side support defining a second side opening; a first leg coupled to and extending from the first side support; a second leg coupled to and extending from the second side support; and a tray coupled to and extending between the first and second side supports, the tray at least partially defining an interior underneath the worksurface, wherein the interior is accessible through the first side opening and through the second side opening.

In some aspects, the invention provides a table including: a worksurface; a first side support coupled to an underside of the worksurface; a second side support coupled to the underside of the worksurface and spaced apart from the first side support; a first leg coupled to and extending from the first side support; a second leg coupled to and extending from the second side support; a support rail extending between the first and second side supports; and a door coupled to the first and second side supports, the door being movable relative to the first and second side supports between an open position and a closed position, wherein an edge of the door is received by the support rail when the door is in the closed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

To avoid crowding the drawings with reference numbers for different ends, sides, etc. of parts of the table, it will be presumed that one of ordinary skill will read this disclosure with the ordinary meaning of directional and positional terms in mind. Throughout this disclosure, for example, the terms "left," "right," "rear," "front," "forward," and "rearward" are used from the perspective of an occupant or user at the table. Terms such as "top" and "bottom" are used with respect to the intended ordinary condition of the table. The term "above" means that one component is positioned higher than another without necessarily being in the same vertical plane. The term "vertically above" means that one component is higher than another thing and in the same vertical plane. "Below" means a component is lower than another component, whereas "vertically below" means that the component is lower and also within the same vertical plane as the other component.

Figure 1:
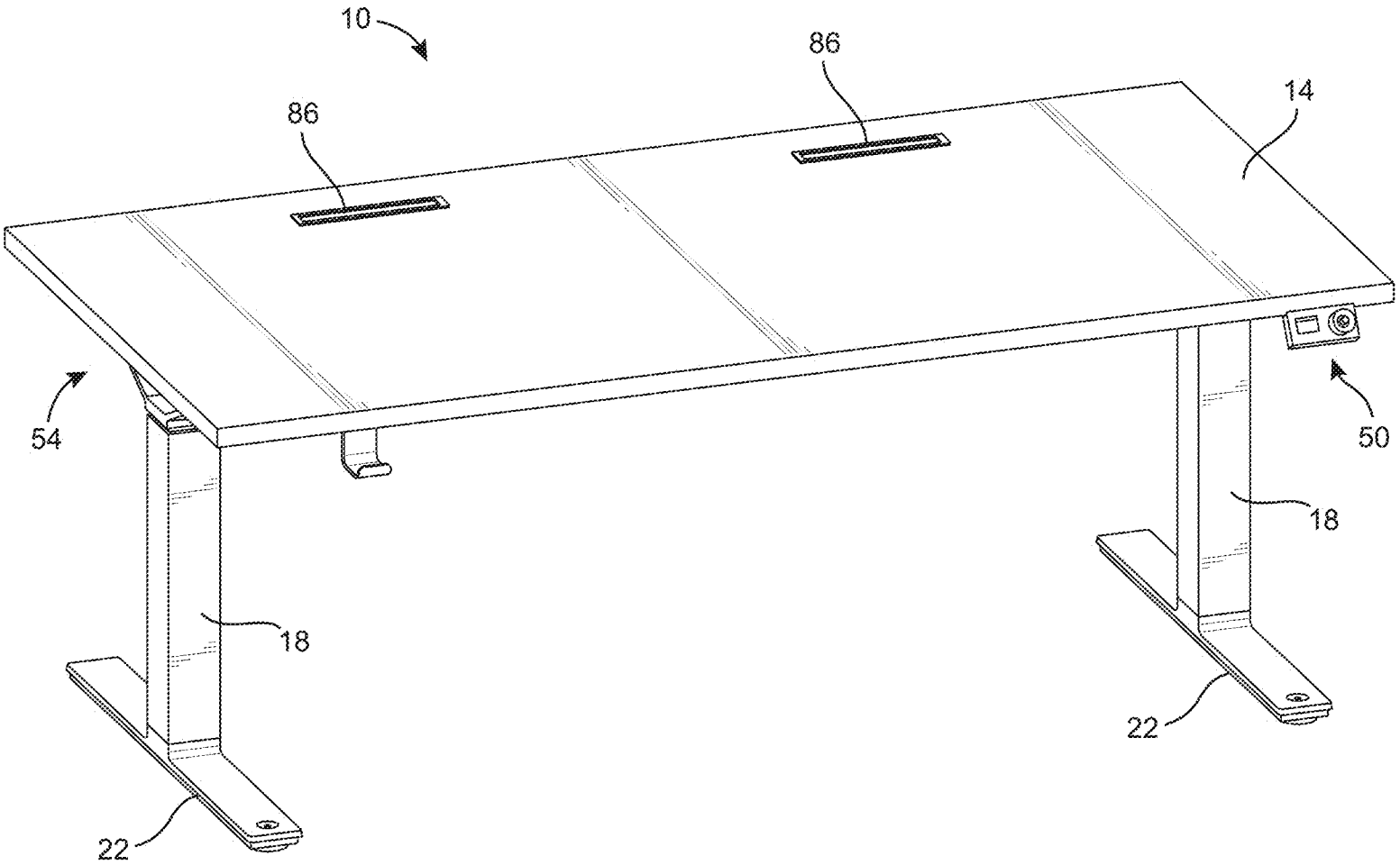
FIG. 1 is a perspective view of a table.

FIG. 1 illustrates a table 10, or desk, to support computers, lights, and other accessories. The table 10 includes a worksurface 14, legs 18 extending from the worksurface 14, and feet 22 coupled to ends of the legs 18 to support the table 10 on a floor or other surface. The illustrated table 10 is a height adjustable table configured to adjust the height of the worksurface 14 relative to the ground. As such, the legs 18 include a movable portion (e.g., a column 23) within a support shell 24 and an actuator 25 (FIG. 5) that is operable to move the column 23 relative to the support shell 24 to adjust the height of the table 10. In other embodiments, the height of the worksurface 14 may be moveable in other ways. In further embodiments, the height of the worksurface 14 may be fixed and the table 10 is not height adjustable. In the illustrated embodiment, the worksurface 14 may be raised relative to the ground in a range between 24 inches and 35 inches from the ground. In other embodiments, the worksurface 14 can be raised to a standing height (e.g., from 24 inches from the ground to 50 inches from the ground). The illustrated table 10 includes two legs 18, but may alternatively include fewer or more legs, such as a single leg or four legs. Additionally, the worksurface 14 may have other configurations (e.g., shapes and/or sizes).

Figure 2:
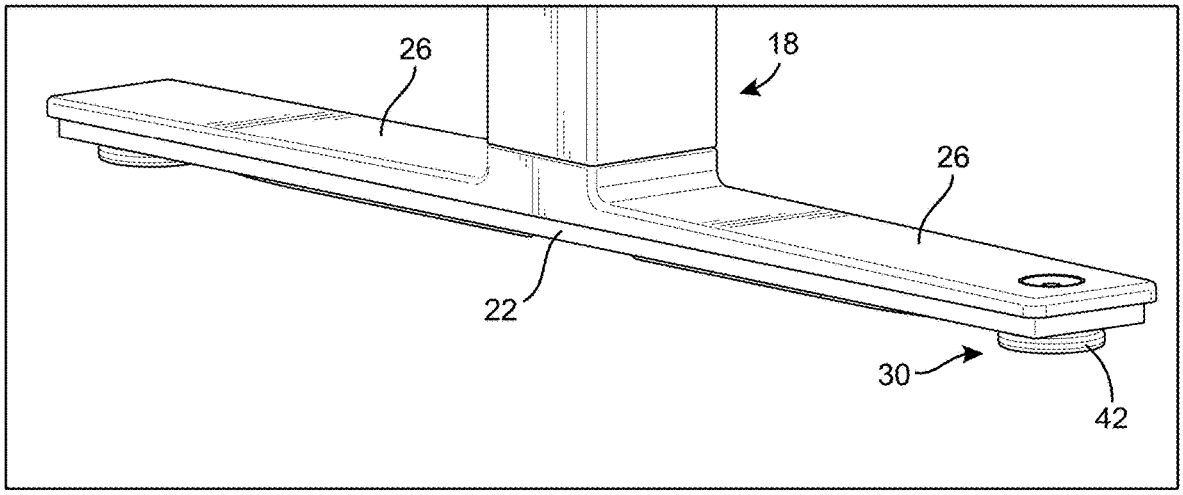
FIG. 2 is a perspective view of a foot of the table of FIG. 1.
Figure 3A:
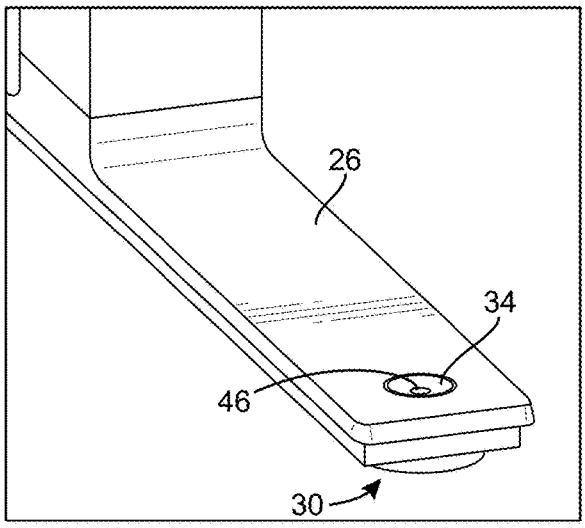
FIG. 3A is a top perspective view of the foot of FIG. 2.
Figure 3B:
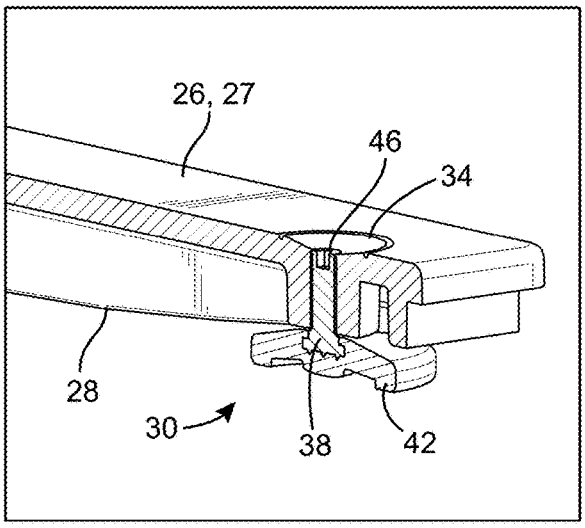
FIG. 3B is a cross-sectional view of the foot of FIG. 2.

With reference to FIGS. 2, 3A, and 3B, each of the illustrated feet 22 include toes 26 extending from the legs 18 in opposite directions. In other embodiments, the feet 22 may extend from the legs 18 in only one direction. Each foot 22 also has an upper side 27 and a lower side 28 formed on each toe 26. The lower side 28 is opposite the upper side 27. The upper side 27, or first side, faces toward the worksurface 14 and away from the ground. The lower side 28, or second side, faces toward the ground and away from the worksurface 14. In the illustrated embodiment, the upper and lower sides 27, 28 are generally planar surfaces. In other embodiments, the upper and lower sides 27, 28 may have other configurations.

Each of the toes 26 includes an adjustable glide 30, only one of which is shown in FIGS. 3A and 3B. The adjustable glides 30 are actuatable to help level the table 10 on the ground or other surface. The adjustable glides 30 are positioned at ends of the toes 26 opposite from the legs 18. In other embodiments, the adjustable glides 30 may be positioned elsewhere on the feet 22. The illustrated adjustable glide 30 includes a cap 34, a fastener 38, and a pad 42. Although only one adjustable glide 30 is described below, the other adjustable glides 30 have similar configurations. The cap 34 is positioned on a top portion of the toe 26 and defines an aperture 46 configured to receive a fastening tool (e.g., a hex-shaped tool, screwdriver, etc.). The aperture 46 opens in a direction away from the ground or in an upwards direction. In other words, the aperture 46 is accessible from the upper side 27 of the foot 22. The fastener 38 extends through the foot 22 and is coupled to the cap 34 and the pad 42. The fastener 38 may be a threaded fastener, such as a bolt. A first end of the fastener 38 is received in the pad 42. For example, the pad 42 may be molded to the end of the fastener 38. A second end of the fastener 38 is received in the cap 34 and may be accessed by the fastening tool through the aperture 46. The pad 42 is positioned adjacent the lower side 28 of the foot 22. The pad 42 may be made of any material or combination of materials to inhibit marring the ground, such as plastics (e.g., nylon), rubber, and the like. In addition, the pad 42 may be made of a low friction material to facilitate sliding the table 10 along the ground, or may be made of a high friction material to inhibit sliding the table 10 along the ground.

A user may insert the fastening tool into the aperture 46 to adjust the height of the pad 42. For example, a user may either rotate the fastener 38 with the tool in a first direction (e.g., clockwise) to axially move the pad 42 toward the foot 22 or rotate the fastener 38 with the tool in a second opposite direction (e.g., counterclockwise) to axially move the pad 42 away from the foot 22. Providing the adjustable glide 30 with the aperture 46 that opens in an upwards direction (i.e., is accessible from the upper side ## of the foot 22) allows a user to easily access the adjustable glide 30 and level the feet 22 of the table 10. In contrast, conventional tables or other furniture typically need to be lifted to access the pads of their glides. In those scenarios, the pads themselves are rotated to move the pads toward and away from the feet of the tables. This arrangement can be cumbersome, especially for heavy tables or tables with glides that are difficult to reach.

Figure 4A:
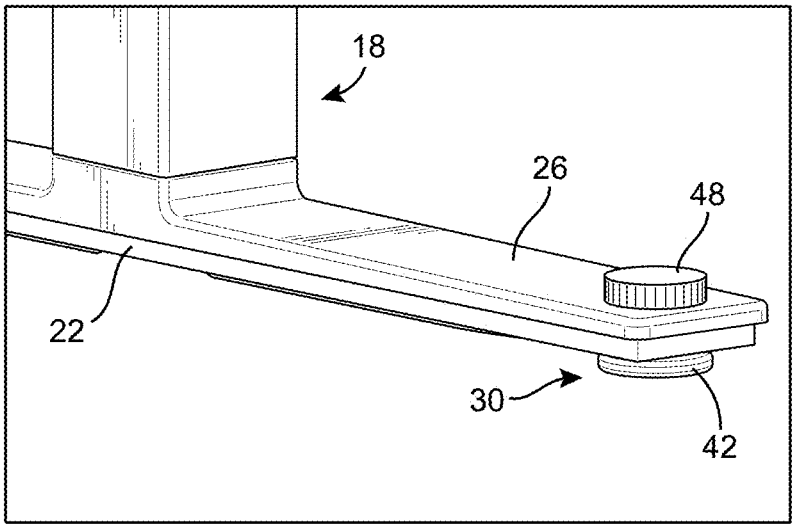
FIG. 4A is a top perspective view of a foot of the table according to another embodiment.
Figure 4B:
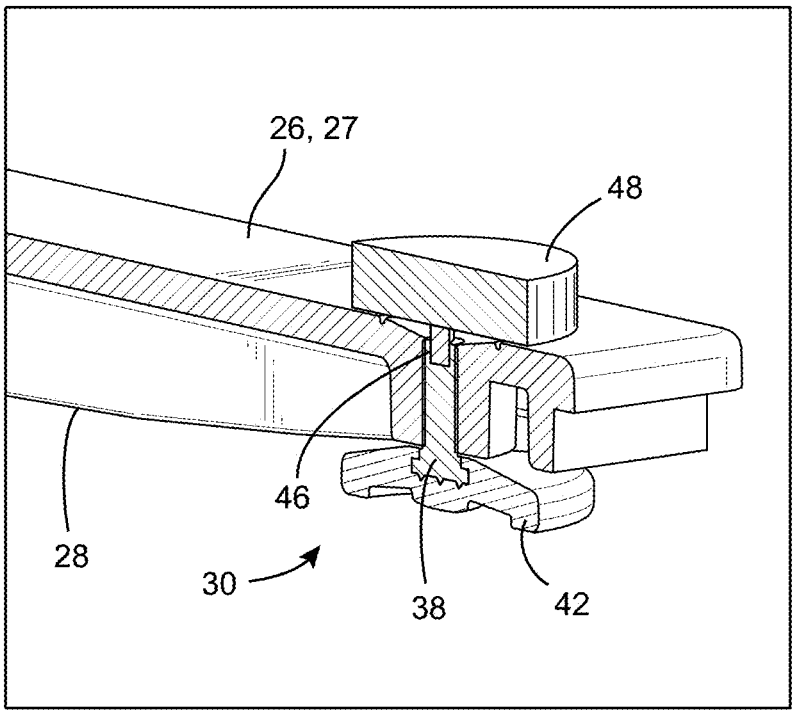
FIG. 4B is a cross-sectional view of the foot of FIG. 4A.

In some embodiments, the adjustable glide 30 may include an actuator coupled to the fastener 38 to rotate the fastener 38. The actuator may be a dedicated component that remains attached to the fastener 38, rather than a tool that is moved from glide to glide 30. For example, as shown in FIGS. 4A and 4B, a dial 48 is coupled to the fastener 38 for rotation with the fastener 38. The dial 48 may include a hex-shaped shank that is received in the aperture 46 or may be integral with the fastener 38. The dial 48 is positioned on the upper side 27 of the toe 26 to allow a user to access the dial 48. The dial 48 may replace the end cap 34 on the upper side 27 of the toe 26. A user may either rotate the dial 48 in a first direction (e.g., clockwise) to axially move the pad 42 toward the foot 22 or rotate the dial in a second opposite direction (e.g., counterclockwise) to axially move the pad 42 away from the foot 22.

With reference back to FIG. 1, the table 10 also includes a control device 50 coupled to the worksurface 14. The control device 50 is operable to adjust the height of the worksurface 14. The control device 50 may also be operable to control other features of the table 10. The table 10 further includes a cable management system 54 to support and direct cables and other components associated with devices that the table 10 supports. In the illustrated embodiment, the cable management system 54 is supported on a bottom side of the worksurface 14. In other embodiments, the cable management system 54 may be supported above the worksurface 14, on a lateral side of the worksurface 14, or on a longitudinal side of the worksurface 14.

Figure 5:
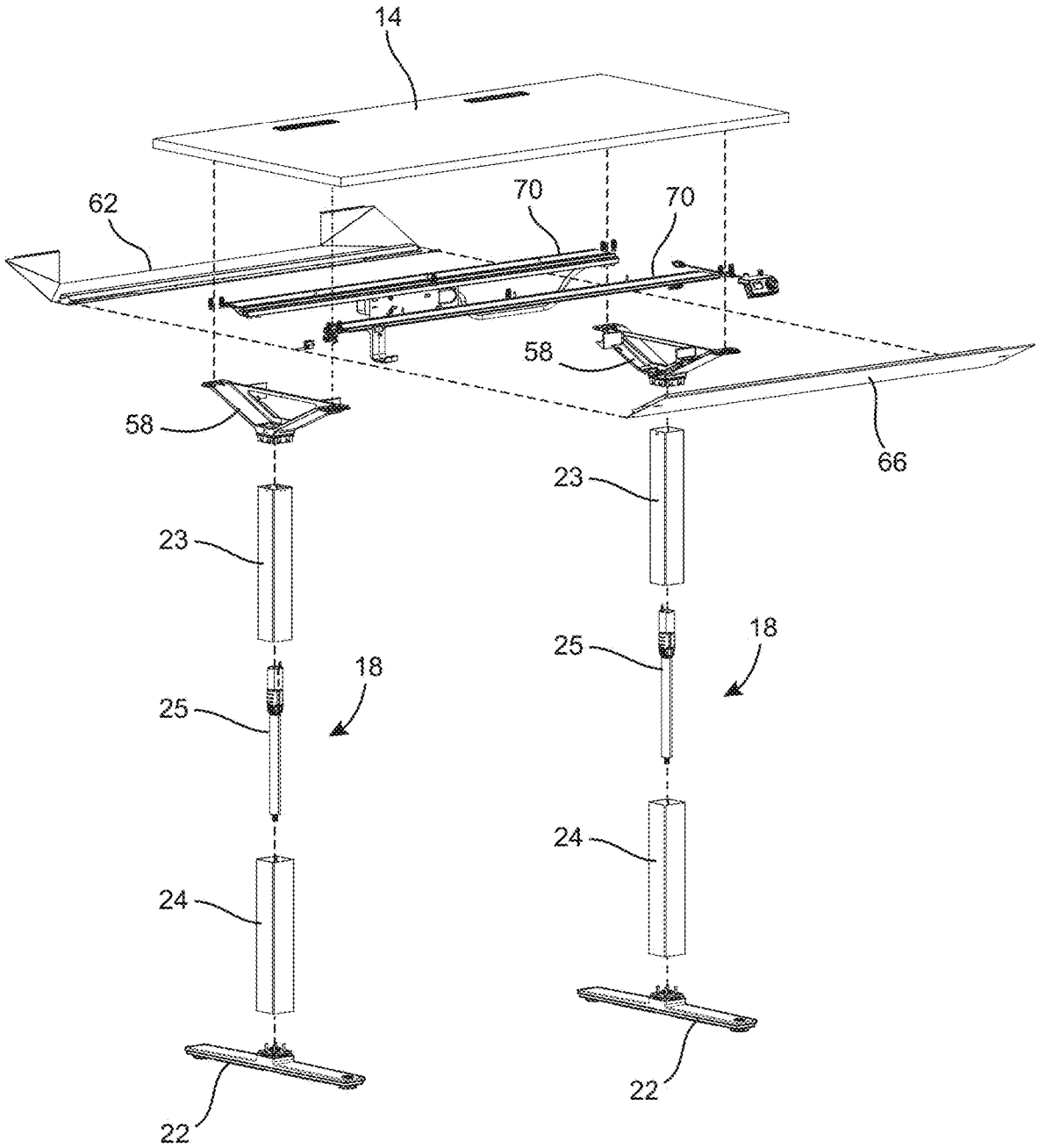
FIG. 5 is an exploded view of the table of FIG. 1.
Figure 6:
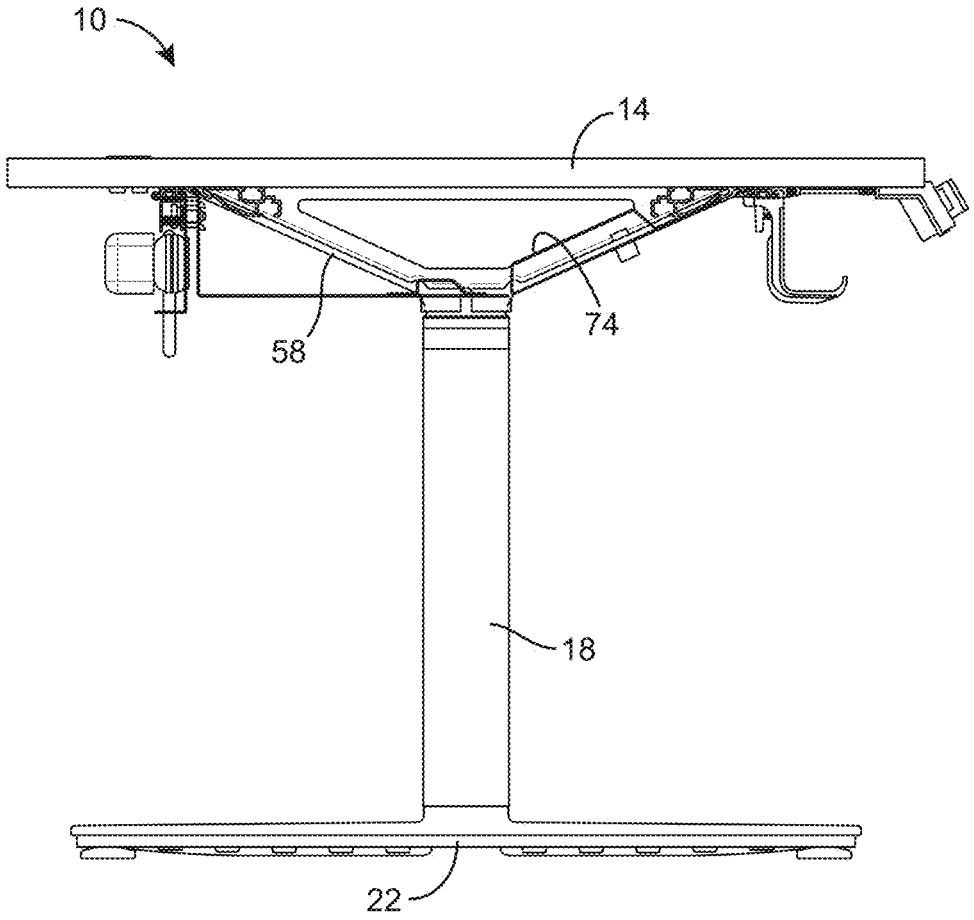
FIG. 6 is a side view of the table of FIG. 1.

With reference to FIG. 5, the illustrated cable management system 54 includes left and right side supports 58, a fixed tray 62, a door 66, and two support rails 70. In the illustrated embodiment, the side supports 58 are V-shaped castings that define side openings 74 (FIG. 6). In other embodiments, the side supports 58 may be other shapes such as triangular, circular or other polygonal shapes. The side supports 58 are coupled to the bottom side or underside of the worksurface 14 at one end and coupled to the legs 18 at the other. The side supports 58 are spaced apart from each other on opposite sides of the underside of the worksurface 14. Moving to FIG. 6, the side supports 58 are centered on respective sides of the table 10 so that the legs 18 and feet 22 are also centrally positioned or disposed relative to the worksurface 14 between a front and rear edge of the worksurface. In other words, the worksurface 14, the side supports 58, legs 18, and feet 22 form an I-shaped profile. In other embodiments, the side supports 58 may be coupled to the worksurface 14 in other positions along the front-rear direction depending on the user's preference. For example, the side supports 58 may be positioned between the center of the worksurface 14 and an edge of the worksurface 14 to form a T-shaped profile. Alternatively, the side supports 58 may be positioned adjacent an edge of the worksurface 14 to form a C-shaped profile. In other embodiments, the side supports 58 may be adjustable relative to the worksurface 14 between multiple positions of the worksurface 14. The side supports 58 support the cable management system 54 underneath the worksurface 14.

Figure 7:
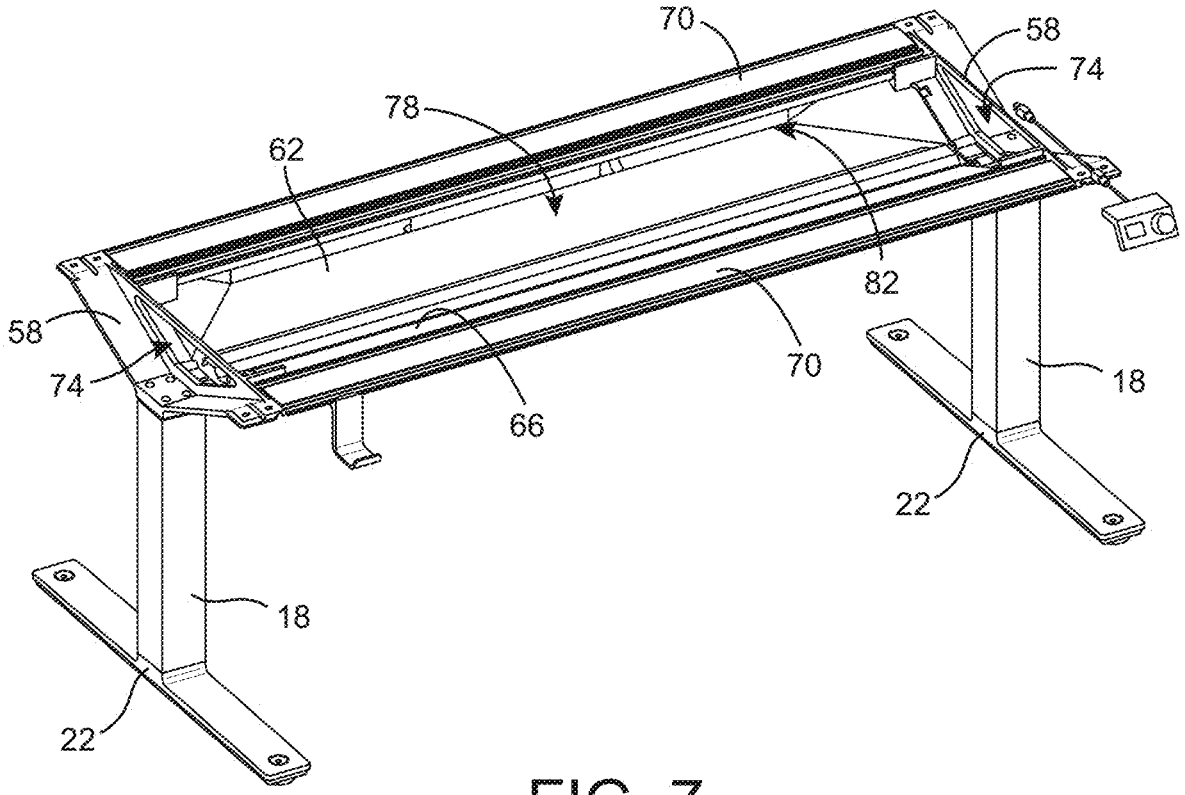
FIG. 7 is a perspective view of the table of FIG. 1 with portions removed.
Figure 8:
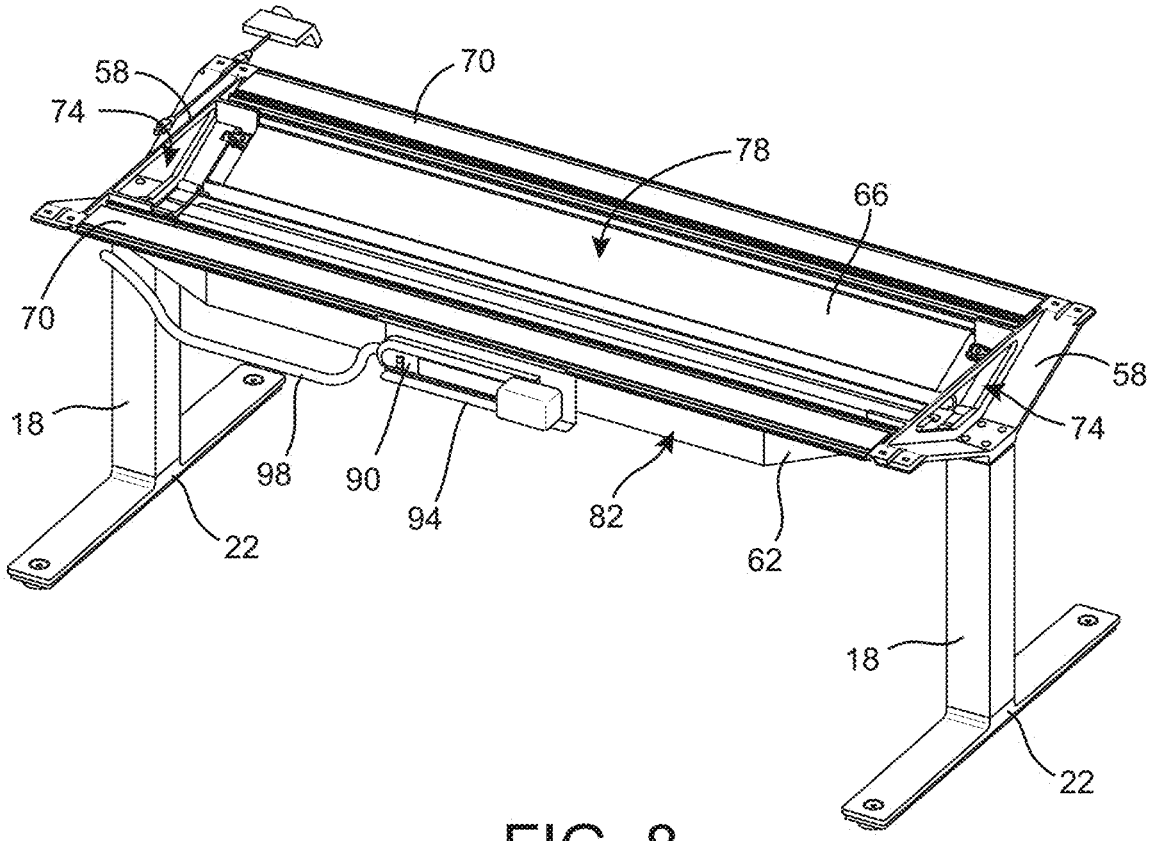
FIG. 8 is another perspective view of the table of FIG. 1 with portions removed.

With reference to FIGS. 7 and 8, the tray 62, the door 66, and the support rails 70 extend between the two side supports 58. Specifically, ends of the tray 62, the door 66, and the support rails 70 are flush with or engage the side supports 58 to form the cable management system 54. As such, the cable management system 54 defines an interior 78 between the worksurface 14, the tray 62, the door 66, and the side supports 58. The tray 62 is fixed between the two side supports 58. That is, the tray 62 does not move relative to the side supports 58. The tray 62 defines a rear opening 82 allowing access to the interior 78 of the cable management system 54. The rear opening 82 is defined between an edge of the tray 62 and one of the support rails 70 and the worksurface 14. The illustrated rear opening 82 extends generally continuously from a first end of the tray 62 to a second end of the tray 62. In some embodiments, the rear opening 82 may only extend partway between the ends of the tray 62. Additionally or alternatively, the rear opening 82 may be formed by multiple discrete or discontinuous openings. The tray 62 also supports cables and other components within the interior 78 of the cable management system 54. Similarly, the side openings 74 of the side supports 58 allow access to the interior 78 of the cable management system 54. Further, the worksurface 14 includes openings 86 (FIG. 1) that extend into the interior 78 of the cable management system 54. In the illustrated embodiment, the worksurface 14 includes two openings 86 on a top side. In other embodiments, the worksurface 14 may include more than two openings 86 or one opening 86. In still other embodiments, the openings 86 may be omitted. The openings 74, 82, 86 allow a user to access cables and other components in the interior 78 of the cable management system 54 and route cables in a preferred direction. In the illustrated embodiment, the cable management system 54 includes a dedicated power strip 90 coupled to a bracket 94. The power strip 90 includes a power cord 98. The power strip 90 provides power to the table 10 and other devices supported by the table 10.

Figure 9:
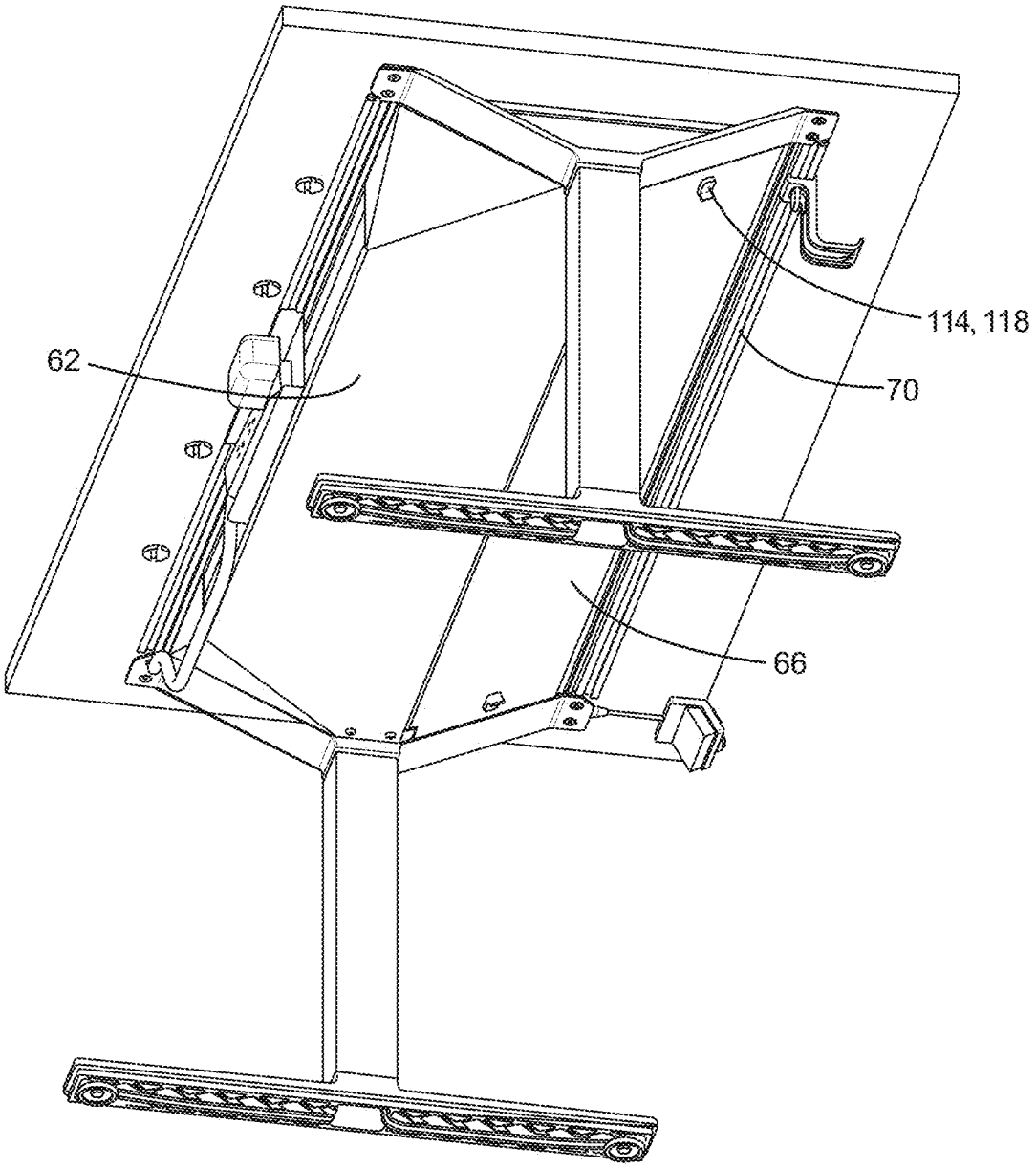
FIG. 9 is a bottom perspective view of the table of FIG. 1.
Figure 10:
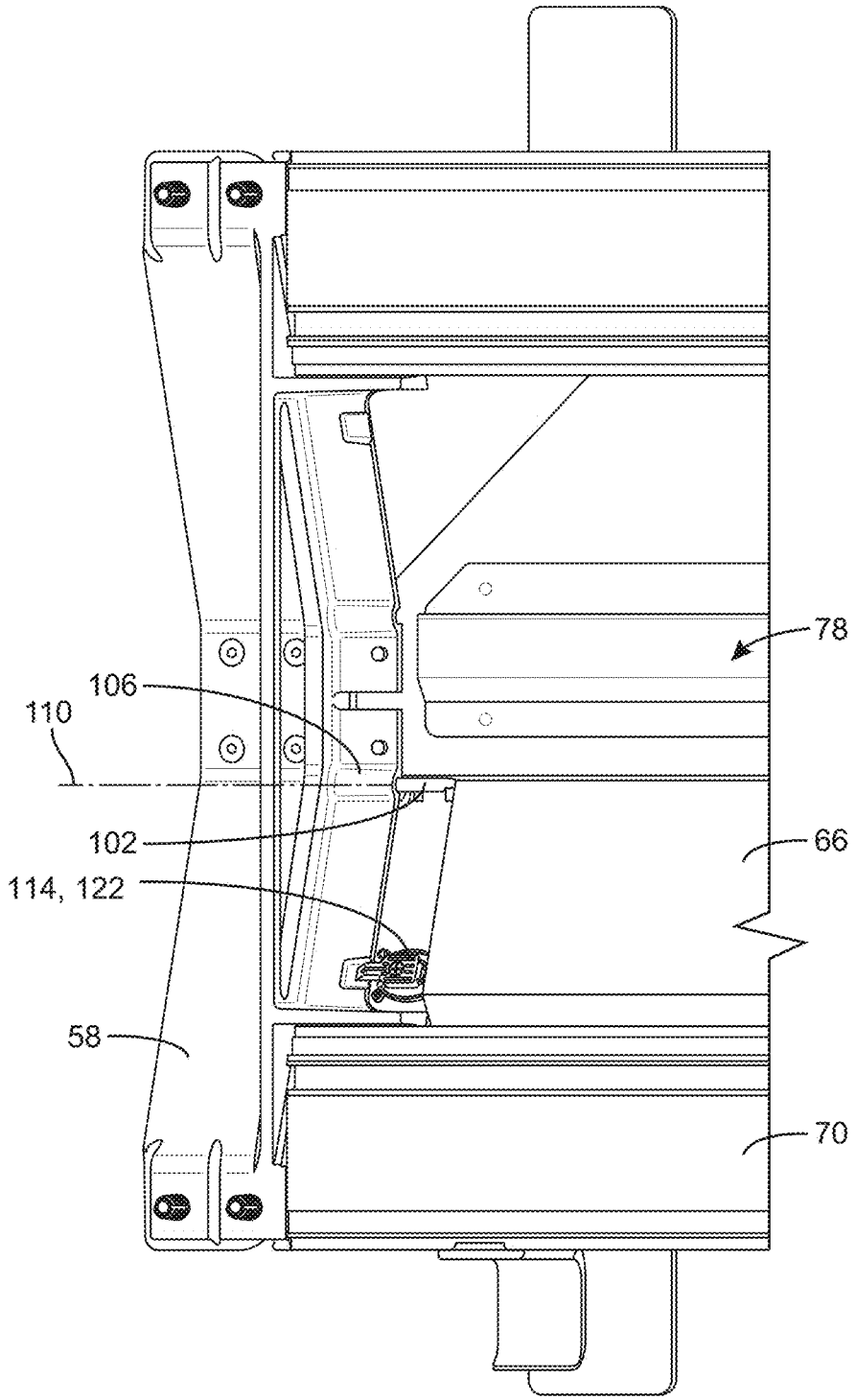
FIG. 10 is a top view of part of the table of FIG. 1 with portions removed.
Figure 11:
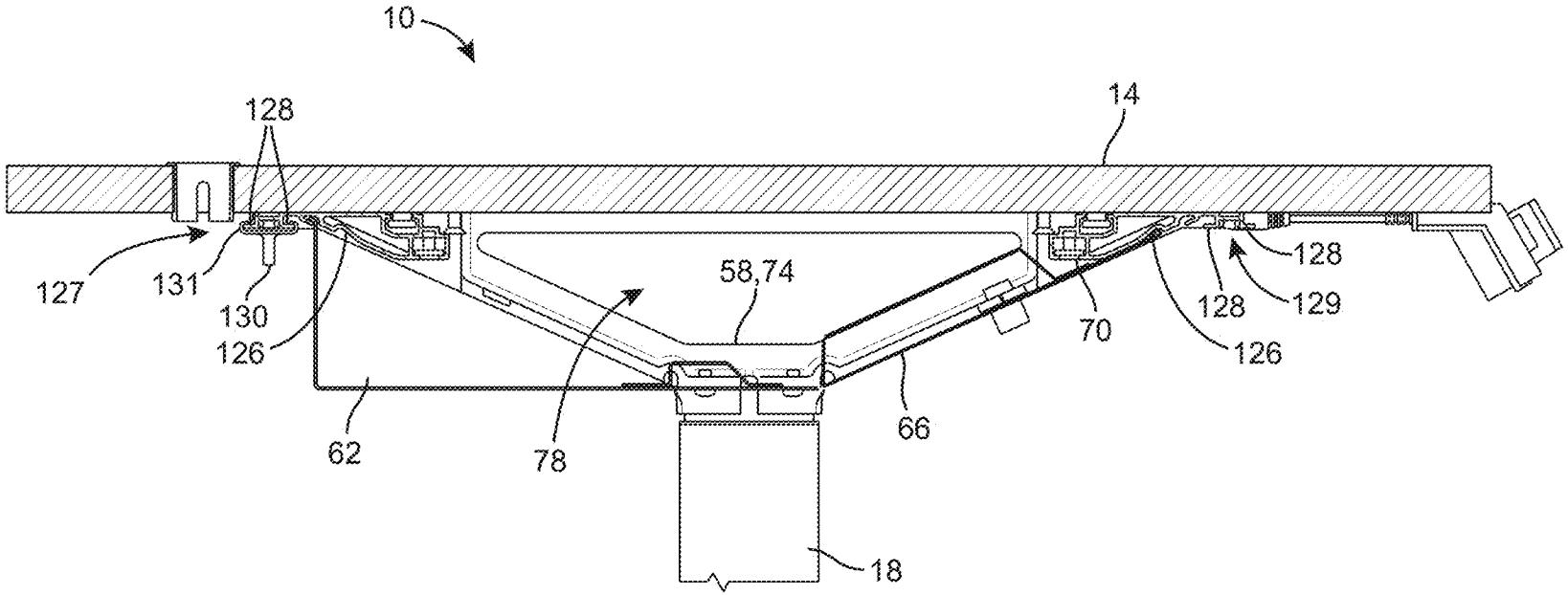
FIG. 11 is a cross-sectional view of the table of FIG. 1.

With reference to FIGS. 9-11, the door 66 is movable (e.g., pivotable) relative to the fixed tray 62 to define a front opening to the interior 78 of the cable management system 54. The illustrated door 66 includes pivot rods 102 that are received within hinge pockets 106 (FIG. 10) of the side supports 58 (only one of each of the hinge pockets 106 and pivot rods 102 are shown in FIG. 10). The door 66 is pivotable relative to the worksurface 14 and the fixed tray 62 about a pivot axis 110 extending through the hinge pockets 106 between an open position and a closed position. In the illustrated embodiment, the pivot axis 110 is positioned adjacent the center of the side supports 58. In other embodiments, the pivot axis 110 may be positioned elsewhere in the front-rear direction of the table 10. The door 66 also includes a pair of latches 114 (one on each side) that are actuatable (e.g., slidable) to selectively move the door 66 between the open and closed positions. The latches 114 include an actuator 118 (FIG. 9) positioned on an exterior side of the door 66 and a spring biased lock 122 (FIG. 10) positioned on an interior side of the door 66. The actuator 118 is coupled to the lock 122 with a fastener.

Figure 10A:
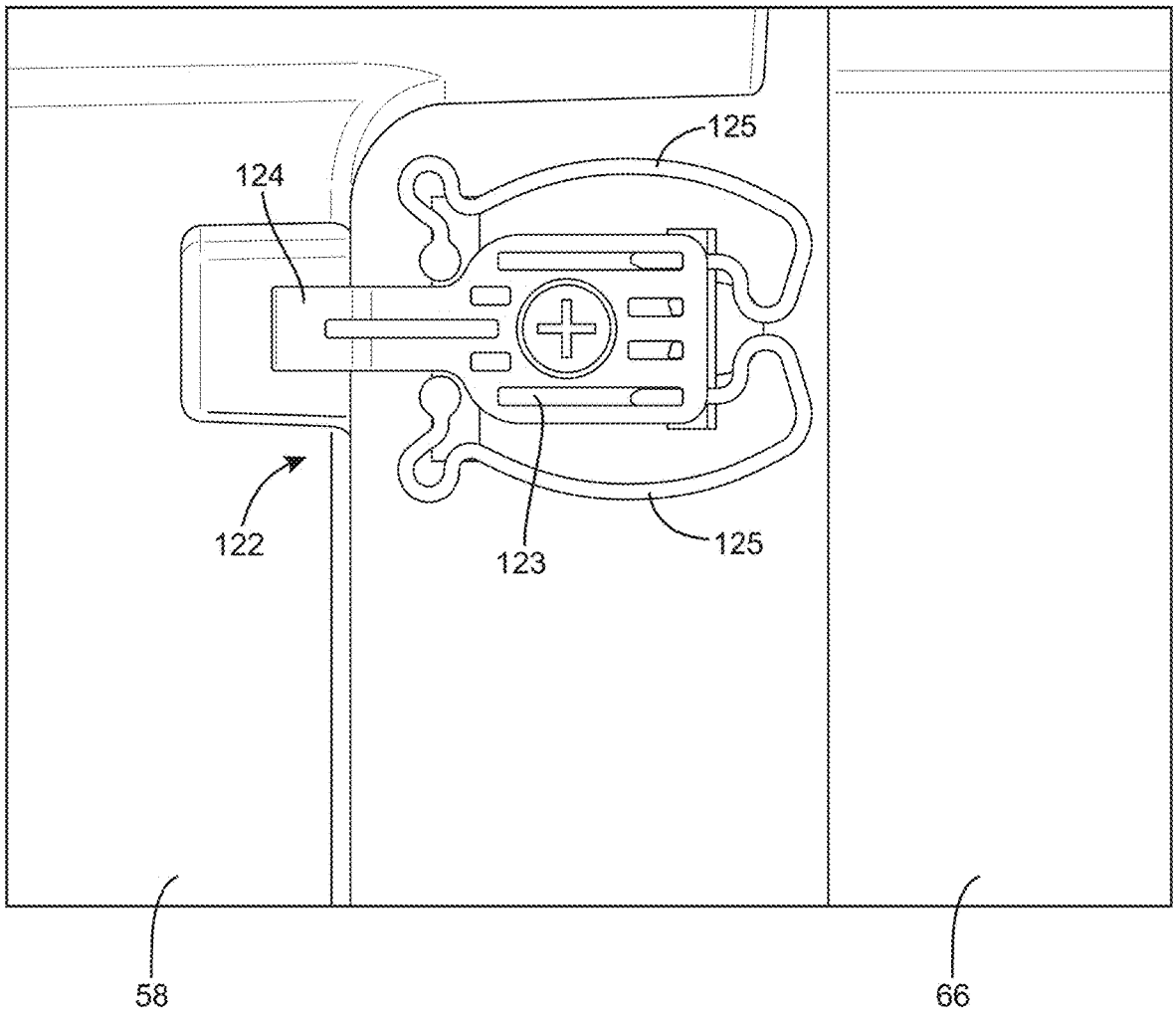
FIG. 10A is a detailed view of a latch for the table of FIG. 1.

As shown in FIG. 10A, each lock 122 includes a body 123 with a protrusion 124 and two opposing resilient members 125. The protrusions 124 engage the side supports 58 to lock the door 66 in the closed position. The resilient members 125 are configured to deform and bias the protrusion 124 to engage the side supports 58. In the illustrated embodiment, the body 123, the protrusion 124, and the resilient members 125 are a unitary component that provides both the locking mechanism for the latch 114 and the biasing force. In other embodiments, the lock 122 may be biased to engage the side supports 58 in other ways. In some embodiments, the lock 122 is made from a plastic material. In further embodiments, the lock 122 may be made from other materials. A user may slide the actuators 118 of each latch 114 towards the other to slide the lock 122 out of engagement with the side supports 58 and release the door 66 allowing the door 66 to move between the closed and open positions. Although not shown, the door 66 may include a track or an abutment that engages the resilient members 125 when the locks 122 are slid towards each other to deform the resilient members 125. As such, when a user releases the actuator, 118 the resilient members 125 bias the body 123 back towards the side supports 58 so that the protrusion 124 engages the side supports 58.

Figure 11A:
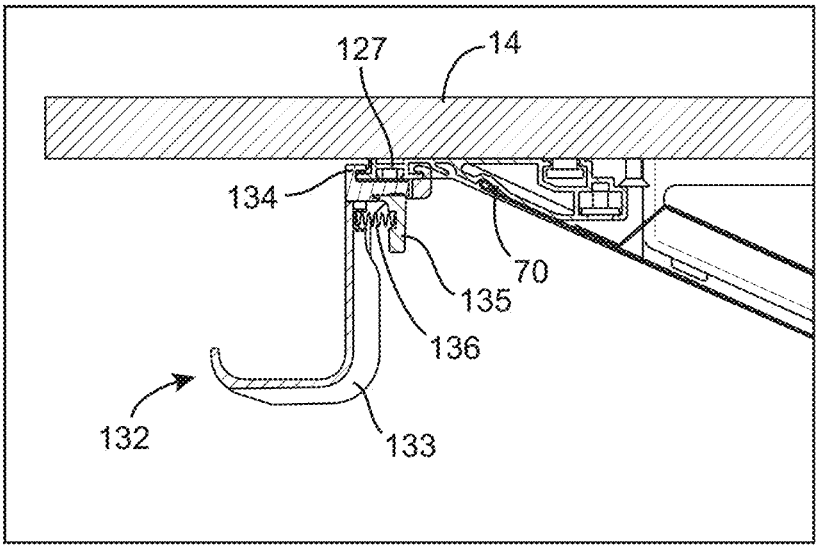
FIG. 11A is a cross-sectional view of the table of FIG. 1 with an accessory.
Figure 11B:
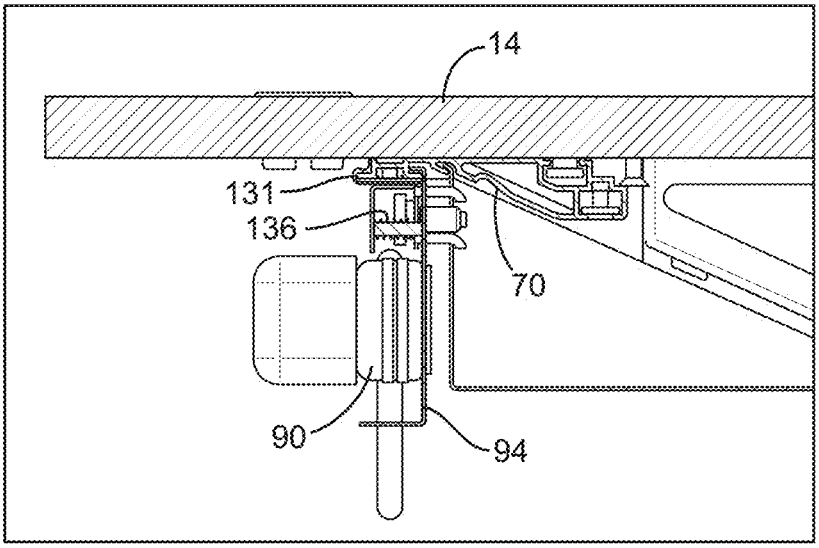
FIG. 11B is a cross-sectional view of the table of FIG. 1 with an accessory according to another embodiment.
Figure 11C:
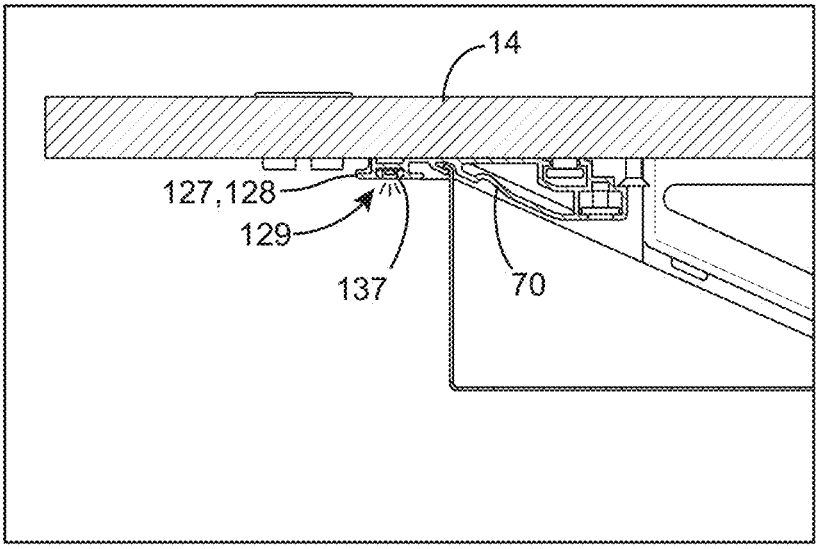
FIG. 11C is a cross-sectional view of the table of FIG. 1 with an accessory according to another embodiment.
Figure 12:
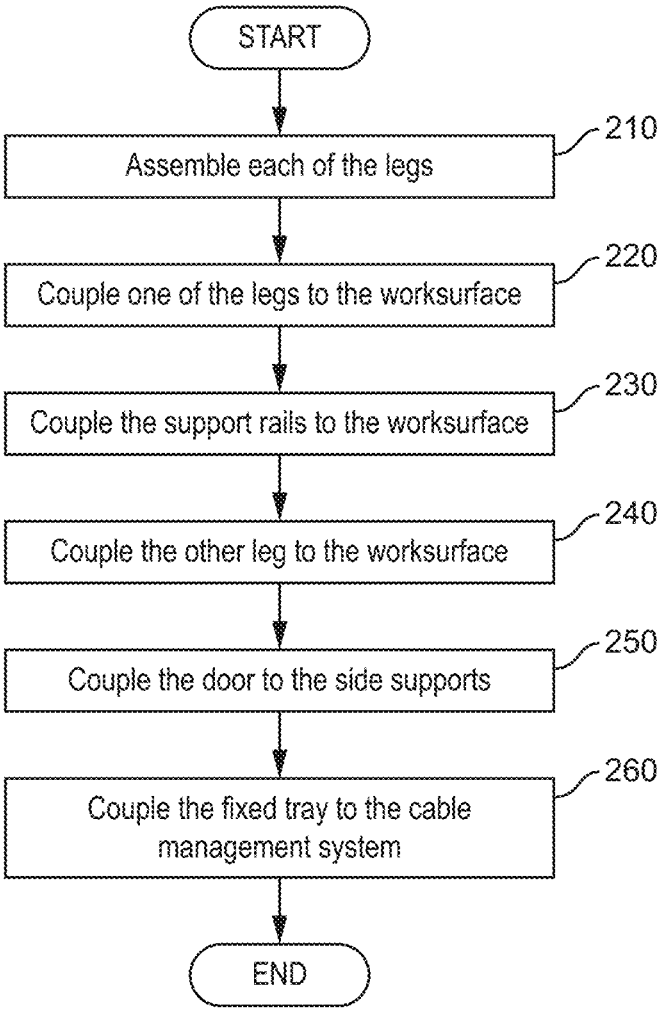
FIG. 12 illustrates a method of assembling the table of FIG. 1.

With reference to FIGS. 11-11C, one of the supports rails 70 is positioned on a front side of the table 10 and the other support rail 70 is positioned on a rear side of the table 10. The support rails 70 act as stiffeners for the worksurface 14 to stabilize the table 10 while moving the table 10 or adjusting the height of the table 10. Each support rail 70 includes a recess 126 and an accessory portion 127. The recesses 126 are configured to receive and position an edge of the door 66 or an edge of the tray 62. For example, as shown in FIG. 11, the recess 126 of the rear support rail 70 receives an edge of the tray 62, and the recess 126 of the front support rail 70 receives an edge of the door 66. The accessory portion 127 includes first and second lips 128 that define a shelf to attach an accessory as will be explained in more detail below. The accessory portion 127 also includes a channel 129 positioned between the first and second lips 128.

With continued reference to FIGS. 11-11C, the accessory portion 127 of the support rails 70 is configured to receive attachments or accessories for the table 10. For example, FIG. 11 illustrates a cord clip 130 that is attachable to the support rails 70. The cord clip 130 helps route cords into and out of the interior 78 of the table 10. The cord clip 130 includes an upper c-shaped bracket 131 that is received by the first and second lips 128. The c-shaped bracket 131 allows for the cord clip 130 to slide along the length of the support rails 70.

As shown in FIG. 11A, the support rails 70 may receive an accessory holder 132. The accessory holder 132 may support an accessory, such as a video game controller. In other embodiments, the accessory holder 132 may support other types of accessories, such as headsets, extra cables, bags, clothing, and the like. In still other embodiments, the accessory holder 132 may be a cup holder, pencil box, a file holder, or the like. The accessory holder 132 is removably and slidably supported by the first and second lips 128 of the accessory portion 127. In the illustrated embodiment, the accessory holder 132 is constructed by a combination of molded components. The accessory holder 132 includes a hook 133, a bracket 134, a stop 135, and a biasing member 136 (e.g., a compression spring). The hook 133 and the bracket 134 combine to define an attachment portion that engages the accessory portion 127 of the rails 70. The stop 135 is coupled to the bracket 134 and the biasing member 136 is positioned between the stop 135 and the hook 133 to bias the hook 133 towards the bracket 134 which provides a clamping force. A user may move the stop 135 or the hook 133 against the basing force to allow the accessory holder 132 to more easily slide along the support rail 70. When the user releases the stop 135 or the hook 133, the hook 133 and the bracket 134 are moved towards each other to secure the accessory holder 132 in place.

As shown in FIG. 11B, the power strip 90 may be coupled to the accessory portion 127 with the bracket 94. The bracket 94 includes a similar c-shaped bracket 131 as the cord clip 130 and a biasing member 136 to secure the power strip 90 in place.

As shown in FIG. 11C, the channel 129 is configured to support a strip of lights 137 that illuminate the area around the table 10. The lights 137 may be LED lights and may be controlled by the control device 50 to change the brightness, color, or other parameters of the lights 137. In further embodiments, the accessory portions 127 may receive other accessories or components.

FIGS. 12-18B illustrate a method of assembling the table 10. Although the illustrated method includes particular steps, not all of the steps need to be performed or need to be performed in the order presented.

Figure 13B:
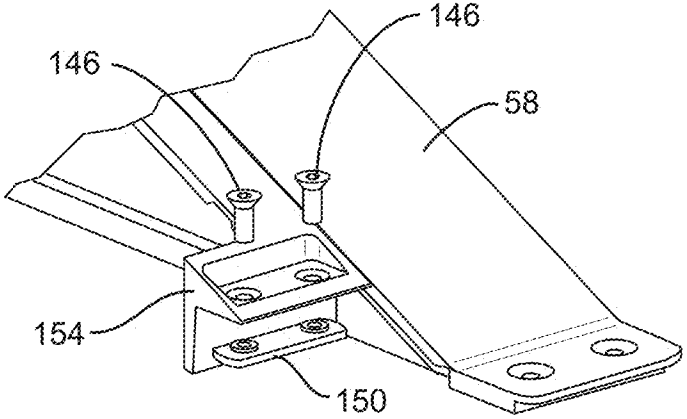
FIG. 13B illustrates a portion of the first step of FIG. 13A.
Figure 13A:
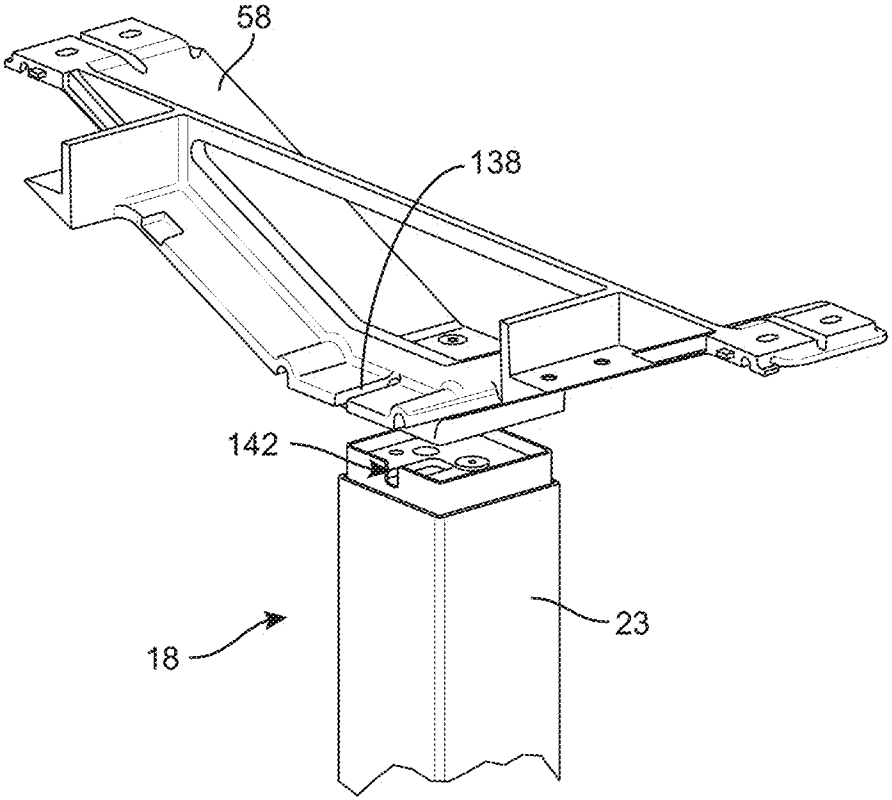
FIG. 13A illustrates a portion of a first step of the method of FIG. 12.

As a first step 210, a user assembles each of the legs 18. As shown in FIGS. 13A and 13B, to assemble the legs 18, a user couples a side support 58 to a column 23 so that a slot 138 aligns with an opening 142 in the leg 18 so that a power cable may run though the interior of the leg 18. A user can then apply fasteners 146 (e.g., screws) to secure the side supports 58 to the legs 18. After the side supports 58 are coupled, a user can then couple the feet 22 to the support shell 24 using the fasteners 146. It should be noted that assembly of the table 10 requires a single tool to apply all fasteners 146. A user then loosely couples nut plates 150 to outer flange portions 154 of the side supports 58 with fasteners 146.

Figure 14:
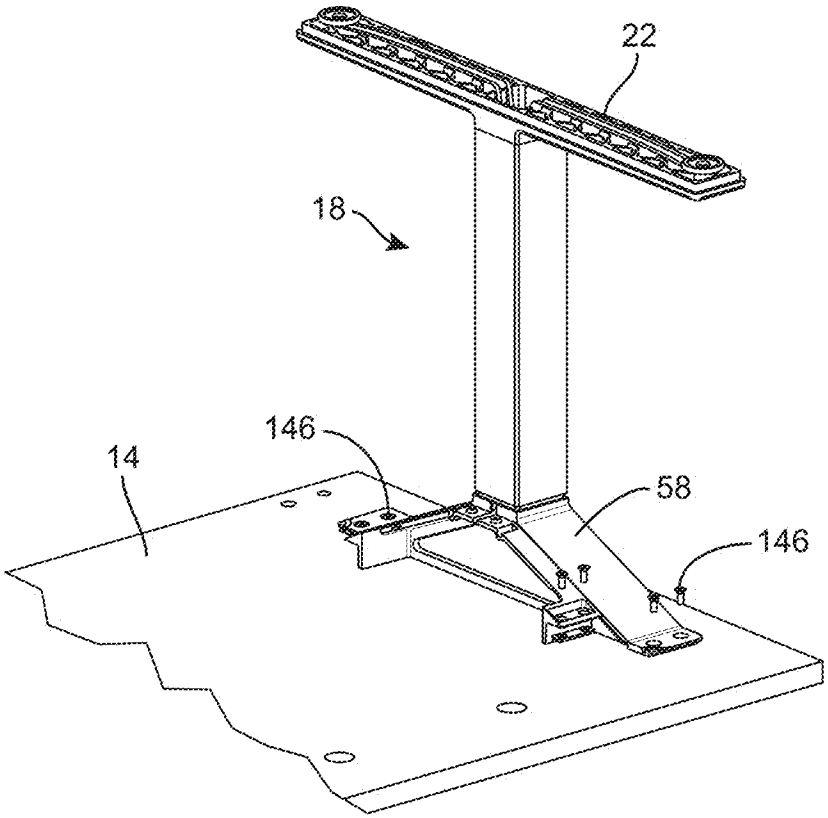
FIG. 14 illustrates a second step of the method of FIG. 12.

As a second step 220, a user couples one of the legs 18 to the worksurface 14. As shown in FIG. 14, to couple one of the legs 18 to the worksurface 14, a user may position the worksurface 14 on the ground or other flat surface and apply fasteners 146 to the ends of the side supports 58. The worksurface 14 includes apertures (not shown) to receive the fasteners 146 and may include indicia to instruct the user where each component is positioned.

Figure 15:
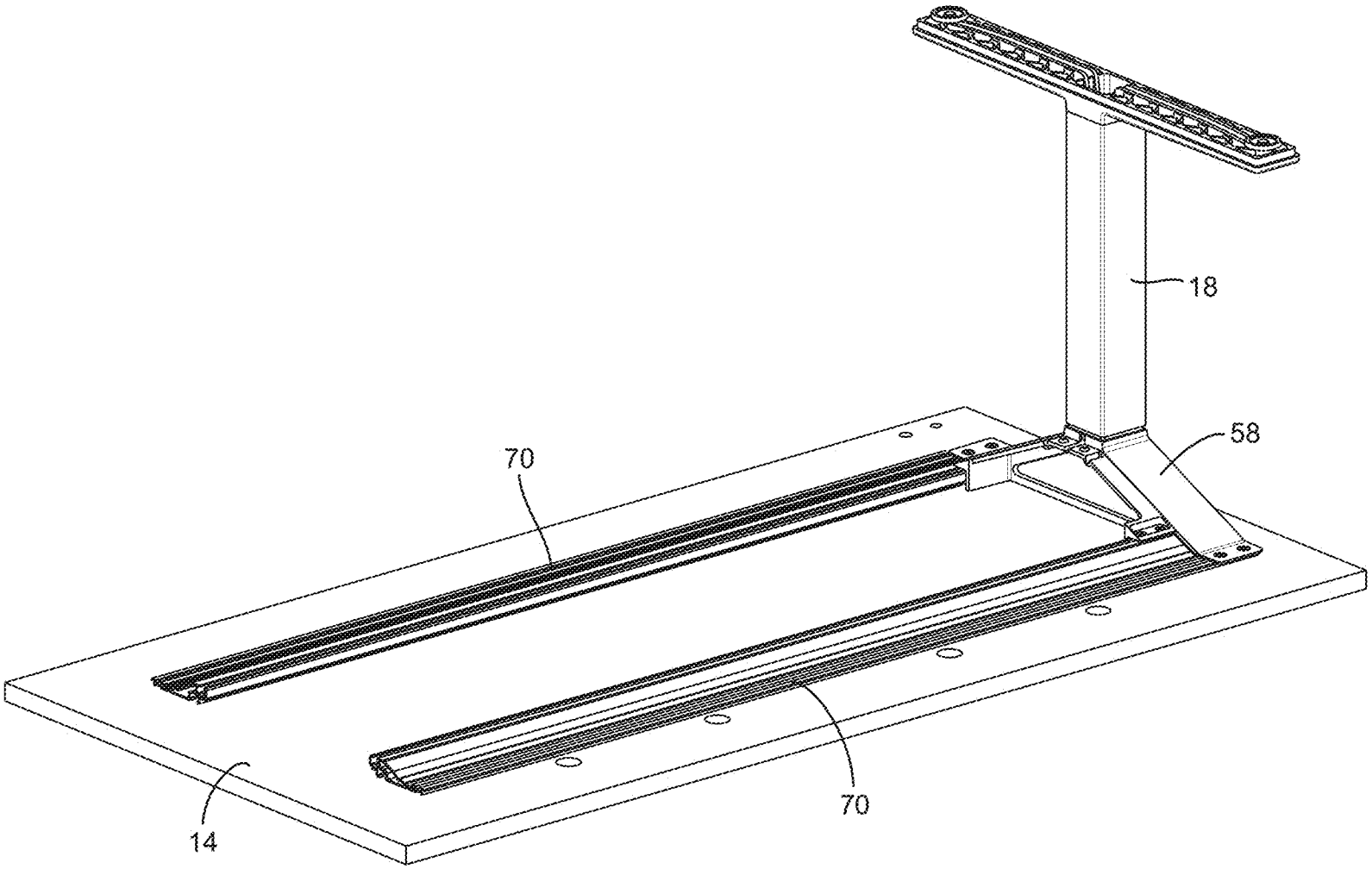
FIG. 15 illustrates a third step of the method of FIG. 12.

As a third step 230, a user couples the support rails 70 to the worksurface 14. As shown in FIG. 15, to couple the support rails 70 to the worksurface 14, a user slides the support rails 70 longitudinally along the bottom side of the worksurface 14 until ends of the support rails 70 are flush with the side support 58 of the attached leg 18.

Figures 16A, 16B:
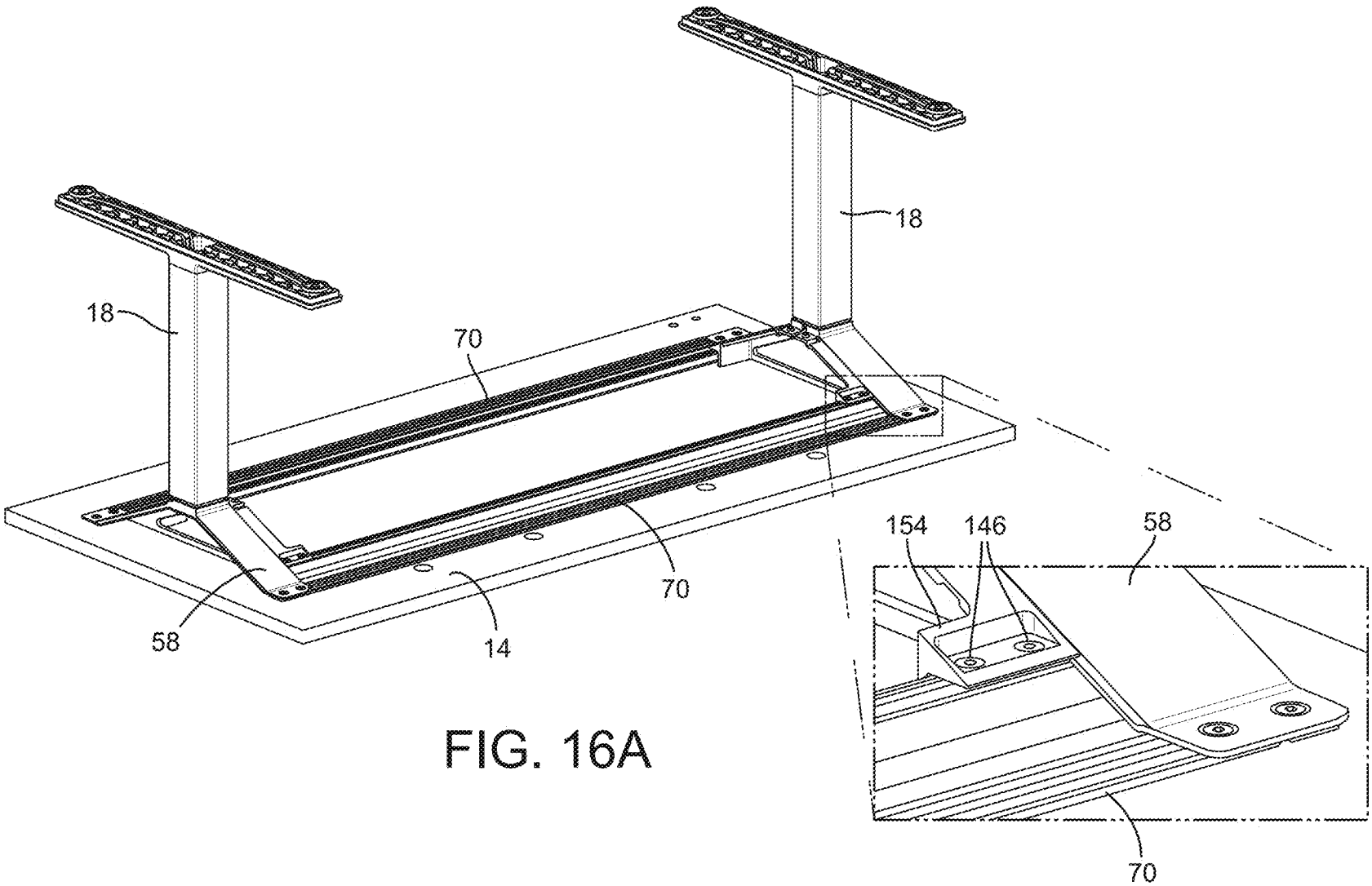
FIG. 16A illustrates a portion of a fourth step of the method of FIG. 12.
FIG. 16B illustrates a portion of the fourth step of FIG. 16A.

As a fourth step 240, a user couples the other leg 18 to the bottom side of the worksurface 14. As shown in FIGS. 16A and 16B, to couple the other leg 18, a user slides the second leg 18 until the other ends of the support rails 70 are flush with the side support 58 of the second leg 18. As the leg 18 slides, the flange portions 154 will overlap the ends of the support rails 70. Then, a user can tighten the fasteners 146 of the nut plate 150 and fastens the second leg 18 to the worksurface 14 with fasteners 146.

Figure 17:
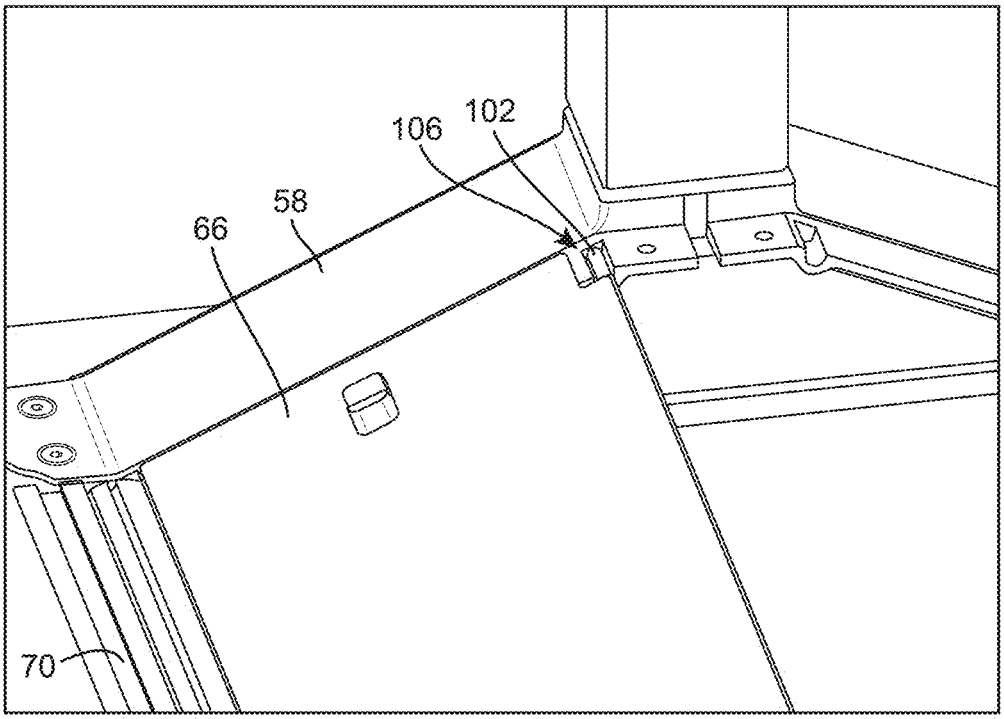
FIG. 17 illustrates a fifth step of the method of FIG. 12.

As a fifth step 250, a user couples the door 66 to the side supports 58. As shown in FIG. 17, to couple the door 66 to the side supports 58, a user positions the pivot rods 102 into the hinge pockets 106. Once the pivot rods 102 and hinge pockets 106 are aligned, a user can then push the pivot rods 102 into the hinge pockets 106 until the pivot rods 102 snap into the hinge pockets 106.

Figure 18A:
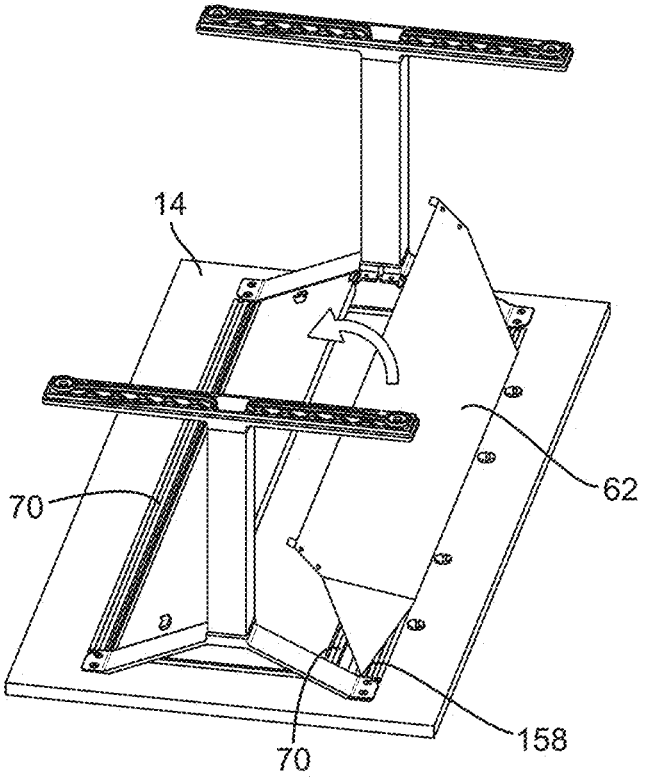
FIG. 18A illustrates a portion of a sixth step of the method of FIG. 12.
Figure 18B:
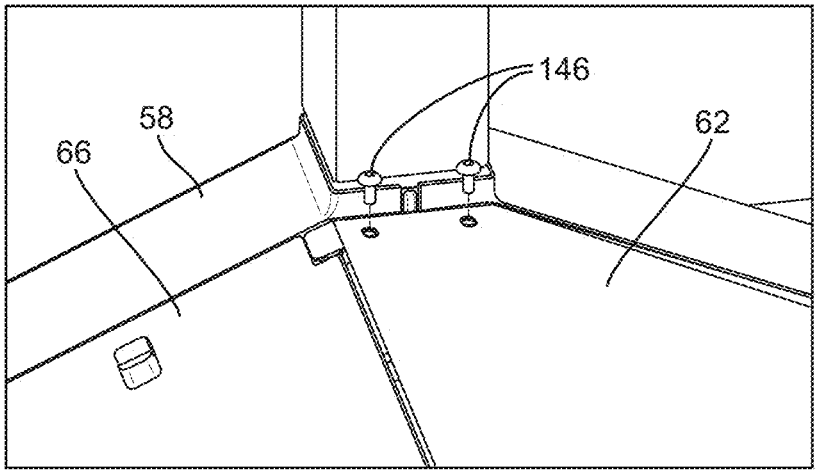
FIG. 18B illustrates a portion of the sixth step of FIG. 18A.

As a sixth step 260, a user couples the fixed tray 62 to the cable management system 54. As shown in FIGS. 18A and 18B, to couple the fixed tray 62, a user positions an edge of the tray 62 into a recess 158 on the rear support rail 70 and rotates the tray 62 until the edges are flush with the side supports 58. A user can then apply fasteners 146 to couple the tray 62 to the side supports 58. After the tray 62 has been installed, a user can flip the table 10 so that the feet 22 are in contact with the ground and the worksurface 14 is positioned above the ground.

Providing a table 10 with a cable management system 54 including a rear opening 82, two side openings 74 and a pivotable door 66 allows a user to customize and organize cables and other accessories used with the table 10 in an easy and efficient way.

Although the invention has been described in detail with reference to certain preferred embodiments, variations and modifications exist within the scope and spirit of one or more independent aspects of the invention as described.

Various features of the disclosure are set forth in the following claims.

What is claimed is:

1. A table comprising:
a worksurface;
a leg coupled to the worksurface;
a foot coupled to the leg, the foot configured to support the worksurface above a ground surface, the foot having an upper side that faces toward the worksurface and a lower side that is configured to face toward the ground surface, the foot defining an aperture with an inner circumferential wall; and
an adjustable glide supported by the foot, the adjustable glide being accessible from the upper side of the foot to axially move the glide relative to the foot and level the table, the glide including,
a fastener positioned within the aperture and having a first end and a second end opposite the first end, and
a pad coupled to the first end of the fastener, the pad configured to engage the ground surface,
wherein the adjustable glide is moveable between a retracted position in which the pad contacts the lower side of the foot and an extended position in which the pad is spaced from the lower side of the foot; and
wherein the second end of the fastener is positioned within the aperture and directly engages the inner circumferential wall of the aperture in the retracted position.

2. The table of claim 1, wherein the adjustable glide further includes an actuator supported adjacent the upper side of the foot, and wherein the actuator is operable to axially move the glide relative to the foot.

3. The table of claim 2, wherein the actuator is a rotatable dial.

4. The table of claim 1, wherein the adjustable glide includes a cap defining an opening configured to receive a tool that is operable to axially move the glide relative to the foot.

5. The table of claim 4, wherein the opening extends into the aperture of the foot.

6. The table of claim 4, wherein the cap defines a concave surface on the upper side of the foot.

7. The table of claim 1, wherein the pad includes a flat bottom surface that engages the ground surface.

8. The table of claim 1, wherein the second end of the fastener is flush with the circumferential wall of the aperture.

9. The table of claim 1, wherein the foot defines a height in a direction between the ground surface and the worksurface and a width in a direction perpendicular to the height, and wherein the width is greater than the height.

10. The table of claim 1, wherein the second end of the fastener is accessible from the upper side of the foot.

11. The table of claim 1, wherein the pad is made from nylon.

* * * * *